US006688580B2

(12) United States Patent
Jackson et al.

(10) Patent No.: US 6,688,580 B2
(45) Date of Patent: Feb. 10, 2004

(54) ADJUSTABLE DIE FOR A FLUID DISPENSER AND METHOD

(75) Inventors: John Jackson, Key West, FL (US); Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 162 days.

(21) Appl. No.: 09/998,876

(22) Filed: Oct. 31, 2001

(65) Prior Publication Data

US 2003/0080307 A1 May 1, 2003

(51) Int. Cl.[7] ..... F16K 31/00

(52) U.S. Cl. ..... 251/205; 251/351; 141/117; 222/504; 239/119; 239/583

(58) Field of Search ..... 251/205, 349; 239/119, 583; 222/504; 141/117, 116, 119, 120

(56) References Cited

U.S. PATENT DOCUMENTS 2,107,987 A * 2/1938 Johnson ..... 141/116
3,895,748 A * 7/1975 Klingenberg ..... 141/119
3,982,724 A * 9/1976 Citrin ..... 222/504
4,030,640 A * 6/1977 Citrin et al. ..... 141/117
4,442,070 A * 4/1984 Proksa et al. ..... 222/527
4,516,702 A * 5/1985 Schmidt ..... 141/116
4,974,754 A * 12/1990 Wirz ..... 222/504
5,033,656 A * 7/1991 Blette et al. ..... 251/7
5,636,790 A 6/1997 Brusko et al.
5,733,597 A 3/1998 Schmitkons et al.
5,816,445 A * 10/1998 Gardos et al. ..... 222/504
6,157,115 A 12/2000 Hassler, Jr.
6,164,568 A 12/2000 Muller et al.
6,257,445 B1 7/2001 Means et al.

* cited by examiner

*Primary Examiner*—John Bastianelli
(74) *Attorney, Agent, or Firm*—Wood, Herron & Evans, L.L.P.

(57) ABSTRACT

A die for dispensing a fluid onto a substrate, wherein the die has an movable lip adjacent a fixed lip to form a die opening therebetween. An actuator is mechanically connected to the movable lip and is operable to automatically move the movable lip with respect to the fixed lip in association with a fluid dispensing process, thereby changing a volume of the die opening. The adjustable die is often a slot die and is used with a fluid dispensing valve having an upstream valve ball. The actuator can be an electromechanical actuator such as a piezoelectric actuator or a fluid operated actuator.

21 Claims, 4 Drawing Sheets

ADJUSTABLE DIE FOR A FLUID DISPENSER AND METHOD

FIELD OF THE INVENTION

The present invention generally relates to a liquid dispenser and method for dispensing fluids and more specifically, to an adjustable die for changing fluid flow through the fluid dispenser.

BACKGROUND OF THE INVENTION

Various fluid dispensers have been developed for the precise placement of fluids. Many fluid dispensers have a valve stem with a valve body or ball on its distal end that is disposed on an upstream side of a valve seat. In operation, the valve ball is moved in an upstream direction to open the valve and in a downstream direction to close the valve. For purposes of this document, the term "upstream" refers to a direction that is toward or closer to a source of fluid for the dispenser; and "downstream" refers to a direction that is further from the source of fluid. With the valve construction described above, when the valve opens, the valve ball is moving in an upstream direction against the direction of fluid flow and has a tendency to delay and disrupt the flow of fluid out of the dispensing nozzle. Similarly, when the valve closes, the valve ball is moving in the downstream direction with the direction of fluid flow; and the upstream valve ball has a tendency to cause a small additional quantity of fluid to be dispensed.

Many fluid dispensing applications require that the fluid be applied to the substrate with sharply defined boundaries, that is, the leading and trailing edges of the applied pattern of fluid on the substrate must be sharply defined or delimited. Thus, it is necessary that the motion of the valve ball be very fast, and the fluid flow be abruptly started and stopped to obtain sharp, square, cut-on and cut-off edges with no stringing of material. Thus, the tendency of the upstream valve ball to dispense even small quantities of fluid after the gun and valve have been shutoff is undesirable.

In order to provide a sharper initiation and cut-off of fluid flow, it is known to snuff-back, that is, temporarily buffer or capture any stringing material or other post shut-off fluid flow before it is deposited on the substrate. The buffered or captured fluid is then deposited during a subsequent fluid dispensing cycle. There are several known approaches to achieve the desired snuff-back function. In one application, excess material is removed from, or held within, a discharge slot of a nozzle by a negative pneumatic pressure created therein immediately upon the dispensing valve being shut-off. Thus, the excess material is not discharged from a nozzle of the fluid dispenser. That material is then discharged from the fluid dispenser during a successive dispensing cycle. Such systems effectively minimize post valve-shutoff fluid dispensing. However, such negative pressure pneumatic systems have extensive additional components; and, in some designs, cylinder chambers are provide in order to buffer the post valve-shutoff fluid. Consequently, such negative pressure designs add significant cost to the dispensing fluid system.

It is also known to provide a sharper initiation and cut-off of fluid flow using a snuff-back valve construction. With this construction, the valve ball is disposed on a downstream side of a valve seat. The valve ball is moved in the downstream direction away from the valve seat to open the valve and in the upstream direction toward the valve seat to close the valve. Consequently, as the valve opens, the valve ball is moving in the same downstream direction as the viscous fluid; and the viscous fluid begins to be dispensed simultaneously with the opening of the valve ball. When the valve closes, the valve ball is moving in the upstream direction and is effective to sharply cut-off the flow of viscous fluid. While such snuff-back valves operate effectively to a provide sharper cut-on and cut-off of fluid flow, snuff-back valves have a more expensive and complicated construction than valves having an upstream valve ball.

Even though such known snuff-back devices work reasonably well, there is a continuing effort to improve the performance and/or reduce the cost of implementing a snuff-back feature. Thus, there is a need for a snuff-back capability that eliminates the complexities of a negative pressure system and can be utilized with known, lower cost, upstream ball valve designs.

SUMMARY OF THE INVENTION

The present invention provides a fluid dispensing die that substantially improves the quality of a fluid dispensing operation. The fluid dispensing die of the present invention is capable of changing its physical geometry and die slot volume to provide increased control over fluid flow during the fluid dispensing process. Further, the die slot volume can be changed in real time to provide a greater volume upon a fluid dispensing valve being shut off, thereby obtaining a snuff-back capability. The fluid dispensing die of the present invention is especially useful with slot die applications where a sharp cut-off of fluid flow is required. The present invention provides a slot die that can be used with dispensing valves that have the valve ball upstream of the valve seat. Such valves are simple, reliable and less expensive than valves designed to provide a snuff-back capability. Hence, the use of dispensing valves having upstream valve balls in slot die applications presents an opportunity for substantial savings.

According to the principles of the present invention and in accordance with the described embodiments, the invention provides a die for dispensing a fluid onto a substrate. The die has first and second lips that define a die cavity therebetween. An actuator is connected to the first lip and is operable to move the first lip relative to the second lip, thereby changing a size of the die cavity.

In one aspect of the invention, the die is a slot die and the actuator can be an electromechanical actuator, a fluid actuator or an electrohydraulic actuator.

In another embodiment of the invention, a fluid dispensing apparatus is provided for dispensing fluid from a fluid source onto a substrate. The fluid dispenser has a fluid dispensing valve connected to the fluid source and a die connected to the fluid dispensing valve. The die has first and second lips that define a die slot therebetween. A lip actuator is connected to the first lip and is operable to move the first lip with respect to the second lip, thereby changing a volume of the die slot between the first and second lips.

In one aspect of this invention, the fluid dispensing valve has a valve ball upstream of the valve seat. Further, the lip actuator moves the first lip relative to the second lip to increase a volume of the die slot so that extra fluid dispensed by the upstream ball valve is maintained in the increased volume of the die slot.

In another embodiment of the invention, a method is provided for automatically changing a size of a die cavity through which fluid is dispensed onto a substrate. A first die lip is positioned adjacent a second die lip to form the die cavity therebetweeen. The first die lip is automatically moved with respect to the second die lip with an actuator in association with a fluid dispensing cycle, thereby changing the volume of the die cavity.

In one aspect of this invention, the first die lip is moved away from the second die lip in association with a closing of a fluid dispensing valve, thereby increasing the volume of the die cavity, so that extra fluid dispensed by the fluid dispensing valve in the process of closing the fluid dispensing valve is contained in the die cavity. In another aspect of this invention, the first die lip is moved toward the second die lip in association with an opening of a fluid dispensing valve, thereby decreasing the volume of the die cavity, so that the extra fluid in the die opening is dispensed onto the substrate.

These and other objects and advantages of the present invention will become more readily apparent during the following detailed description taken in conjunction with the drawings herein

DETAILED DESCRIPTION OF THE INVENTION

Figure 1A:
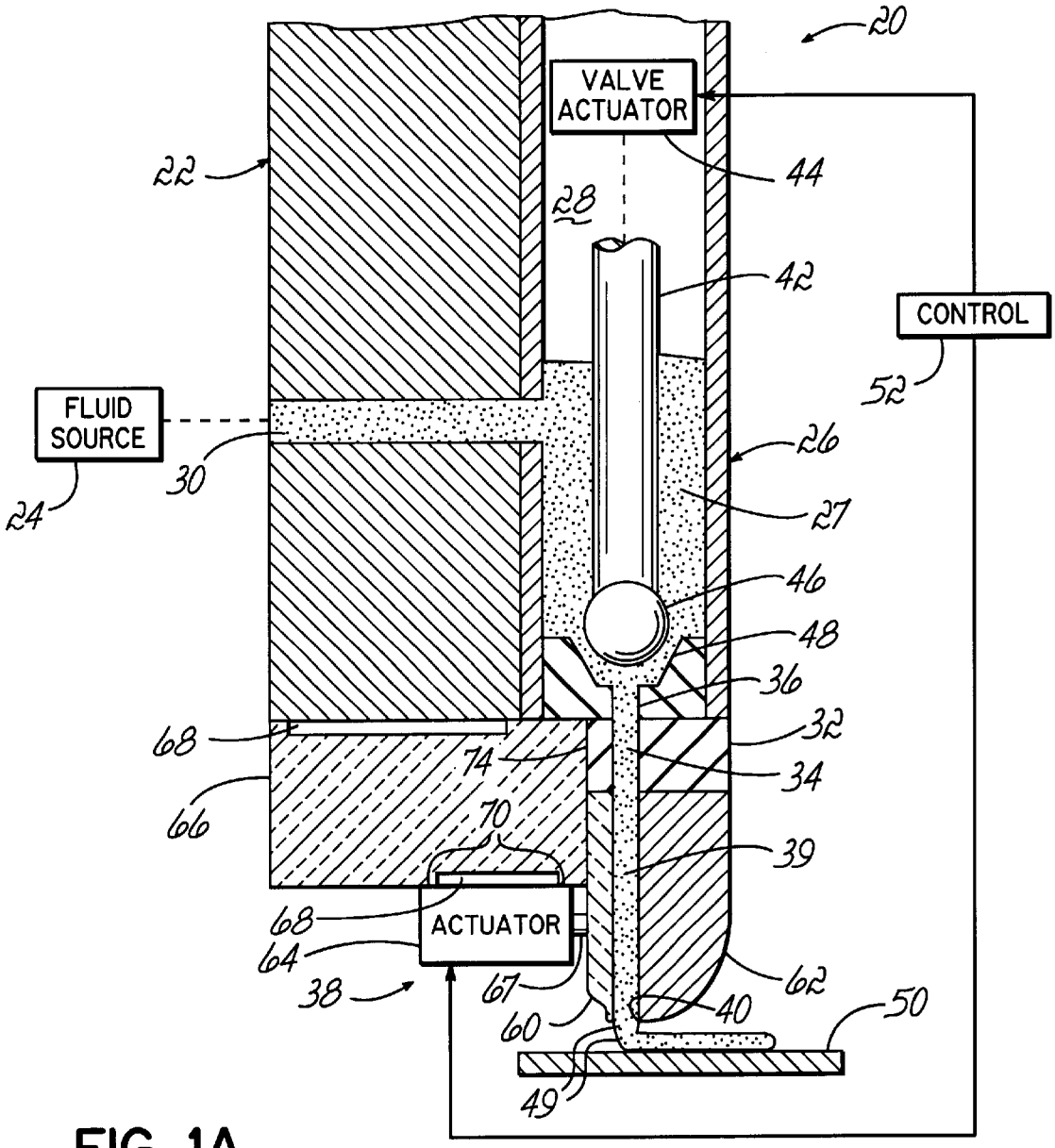
FIGS. 1A and 1B are schematic, partial cross-sectional diagrams illustrating an operation of a fluid dispensing system employing one embodiment of the snuff-back die in accordance with the principles of the present invention.

Referring to FIG. 1A, a fluid dispensing system 20 is comprised of a dispensing head 22 fluidly connected to a source of pressurized fluid 24. A supply valve 26 is mounted on the dispensing head 22 and has a fluid passage 28 fluidly connected to an inlet 30 of the dispensing head 22 and the source of pressurized fluid 24. A distribution plate or manifold 32 is also mounted on the dispensing head 22 and has a fluid path 34 with an upstream end connected to an outlet 36 of the supply valve 26. A die 38 is mounted to the distribution manifold 32 and has a first and second lips, 60, 62 that define a fluid or die cavity 39, for example, a die slot, therebetween. The die cavity 39 has an upstream end fluidly connected to a downstream end of the fluid path 34. Thus, the die cavity 39 provides a flow path for the fluid 27 through the die 38. A downstream end of the die cavity 39 terminates with a die opening 40 contiguous with the fluid path 34.

The supply valve 26 has a valve stem 42 that is mechanically connected at one end to a valve actuator 44. The valve stem 42 has a valve ball 46 at its distal end that engages a valve seat 48. The valve actuator 44 is operative in a known manner to move the valve stem 42 and ball 46 away from the valve seat 48 to open the supply valve 26. When open, the supply valve 26 permits a flow of fluid through the outlet 36, the fluid path 34 and die opening 40, thereby depositing fluid on a substrate 50 that has a relative motion with respect to the dispensing head 22. The valve actuator 44 is further operative to move the valve stem 42 and ball 46 into mating engagement with the valve seat 48, thereby terminating the flow of fluid through the die opening 40 and onto the substrate 50.

As previously described, many fluid dispensing applications require a very sharp delineation or cut-off of fluid flow when the supply valve 26 closes. However, as the valve ball 46 moves downward into the valve seat 48, the valve ball 46 moves additional fluid through the fluid path 34 and die opening 40. That additional fluid sometimes strings out or otherwise exits the die opening 40 and is deposited on the substrate 50. Such residual or extra fluid flow and deposition on the substrate 50 are detrimental to having a sharp fluid flow cut-off. Thus, such imprecise cut-offs of fluid flow often adversely impacts the quality of the fluid deposition process on the substrate 50.

In order to improve the precision of the fluid flow cut-off, the present invention provides a snuff-back die 38 mounted to the distribution manifold 32 or another part of the dispensing head 22. The die 38 has a movable die lip 60 and an opposed, fixed die lip 62 that define or form the die cavity 39 therebetween. A lip actuator 64 has a movable portion 67 that is mechanically coupled to or linked with the movable lip 60. The lip actuator 64 may be an electrically operated fluid actuator, for example, a pneumatic or hydraulic actuator or cylinder, or an electromechanical actuator, for example, a multilayered ceramic piezoelectric device. Such a device is formed by a laminated series or stack of piezoelectric ceramic layers separated by a conductive film. Further, such a piezoelectric device has a small displacement, for example, about 0.001 inches, but can have a high output force, for example, about 300 pounds.

In many applications, such a small actuator displacement is insufficient to reliably operate a device or otherwise produce much effect. However, if the die 38 is a contact slot die as shown in FIG. 1, the die lips 60, 62 have a substantial width relative to a thickness of the die slot 39. As used herein, the width of the slot 39 is a dimension in a direction substantially perpendicular to the cross-sectional plane viewed in FIGS. 1 and 2. Further, the thickness of the die slot 39 is the distance between the die lips 60, 62. Therefore, a relatively small change in the thickness of the die slot 39 provides a relatively large change in the die slot volume. Further, the extra volume of fluid displaced by the upstream valve ball 46 when the dispensing valve 26 is closed is relatively small compared to the volume of the die slot 39. That small extra volume of fluid can be accommodated by a small increase in the size or volume of the die slot 39, thereby providing a snuff-back action.

Therefore, the relatively small displacement of a piezoelectric device when implemented as the actuator 64 can be used to effectively vary the size of the die slot 39 by moving the movable die lip 60 toward and away from the fixed die lip 62. Such small movements of the movable lip 60 to vary the volume of the die slot 40 can effectively be used to provide a snuff-back action or capability within the slot die 38. Further, the high output force of the piezoelectric device is useful in overcoming the hydraulic forces applied against the movable lip 60 by the viscous fluids that are being dispensed therethrough.

A small actuator, such as a piezoelectric device, is sensitive to a harsh or high temperature thermal environment. Therefore, to provide for a more consistent operation of the actuator 64, its thermal environment is somewhat controlled by insulating it from other components of the dispensing head 22. For example, heaters are often employed in the dispensing head 22 to maintain the fluid at a desired temperature. Therefore, an insulating block 66 is used to insulate the actuator 64 from the main body of the dispensing head 22. The insulating block 66 can be made from any suitable material having a low thermal conductivity, for example, a ceramic, stainless steel, etc. Further, one or more air gaps 68 are also used to provide a further insulating/cooling function.

In the embodiment of FIG. 1, the actuator 64, for example, a piezoelectric device, is bonded or otherwise attached to the insulating block 66 at points 70. The bonding or other attaching technique may further thermally insulate and isolate the actuator 64 from other components in the dispensing head 22. Further, the actuator 64 has a movable element or portion 67 that is bonded or otherwise attached to the movable lip 60. In one embodiment, the movable lip 60 may be made from a material having a lower thermal conductivity than die materials that are often used. One example of a material having a lower thermal conductivity is stainless steel. In an alternative embodiment, the movable lip 60 may have an insulating material laminated to an outer side to which the actuator 64 is attached. In another alternative embodiment, the movable lip 60 may have an insert of a low thermal conductivity material to which the actuator 64 is attached.

In the embodiment of FIG. 1, the slot die 38 is often comprised of an assembly of the die lips 60, 62 and a shim (not shown) interposed between the die lips 60, 62 in a known manner. The shim is used to provide a seal between the lips 60, 62 and form a desired profile over a width of the die slot 39 in order to create a desired fluid dispensing pattern. Further, a slot die 38 often has a plurality of slots extending along its width, and each of the plurality of slots is supplied fluid by a fluid dispensing valve identical to the fluid dispensing valve 26. The slot die assembly 38 is fastened or otherwise connected to the distribution plate 32 or another part of the dispensing head 22.

Figure 1B:
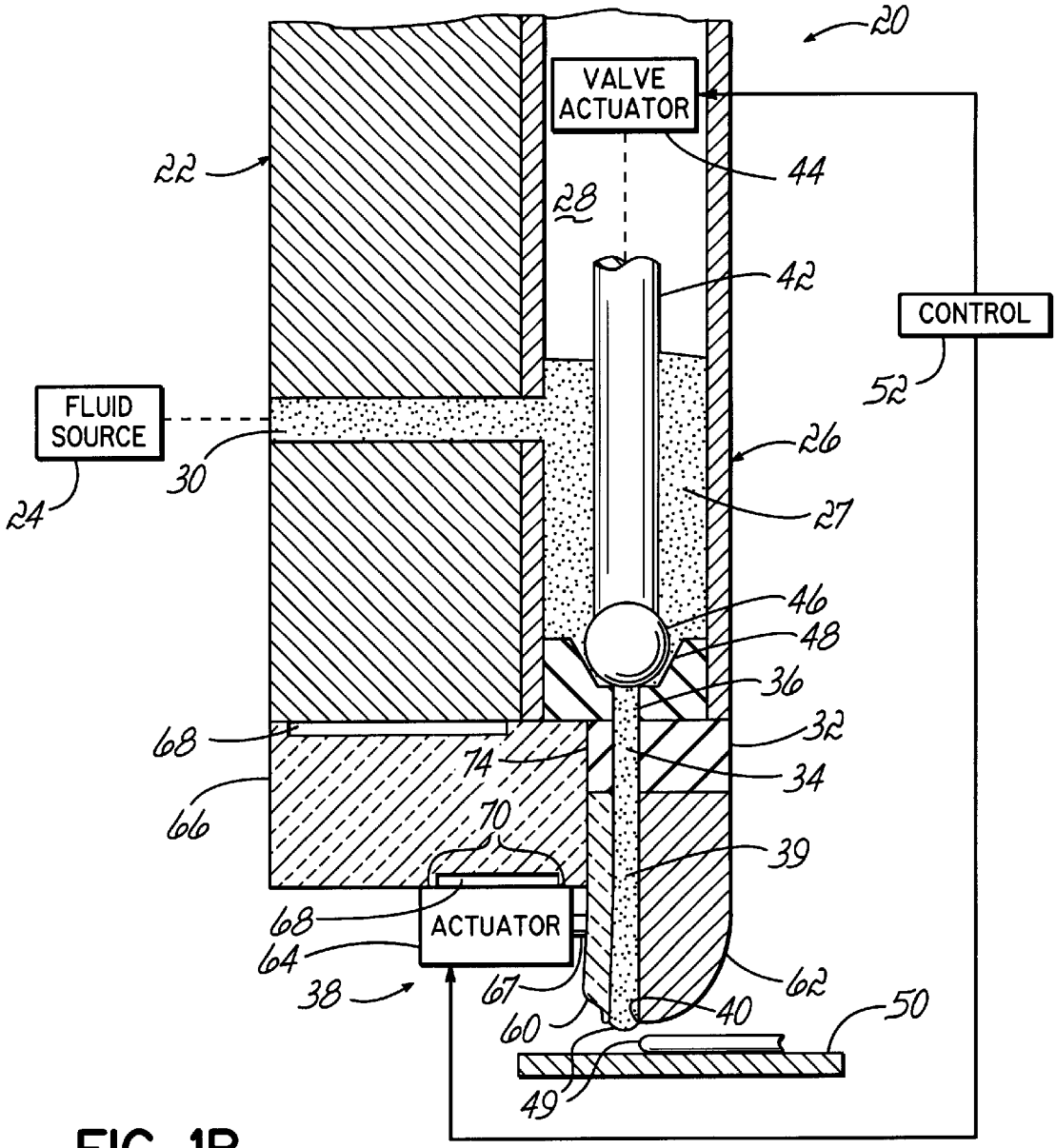

The movable lip 60 is disposed adjacent a side 74 of the insulating block 66 in such a manner that the movable lip 60 is able to bend or deflect a small amount in a direction toward the insulating block 66, as shown in FIG. 1B, thereby increasing the size volume of the die slot 39. For example, the movable lip 60 may be spaced a small distance away from the side 74 of the insulating block 66. In an alternative embodiment, the side 74 of the insulating block 66 adjacent the movable lip 60 may be shaped inward or angled inward from top to bottom. Such a profile provides a larger gap or spacing from the movable lip 60 near the bottom of the insulating block 66, thereby providing a space in which the movable lip 60 can be moved in order to increase the thickness of the slot die 38. In a further alternative embodiment, the insulating block 66 may have a deformable or resiliently deformable material laminated thereon. Thus, the movable lip 60 is able to deform the side 74 of the insulating block 66 as the actuator 64 deflects the movable lip 60.

Figure 2A:
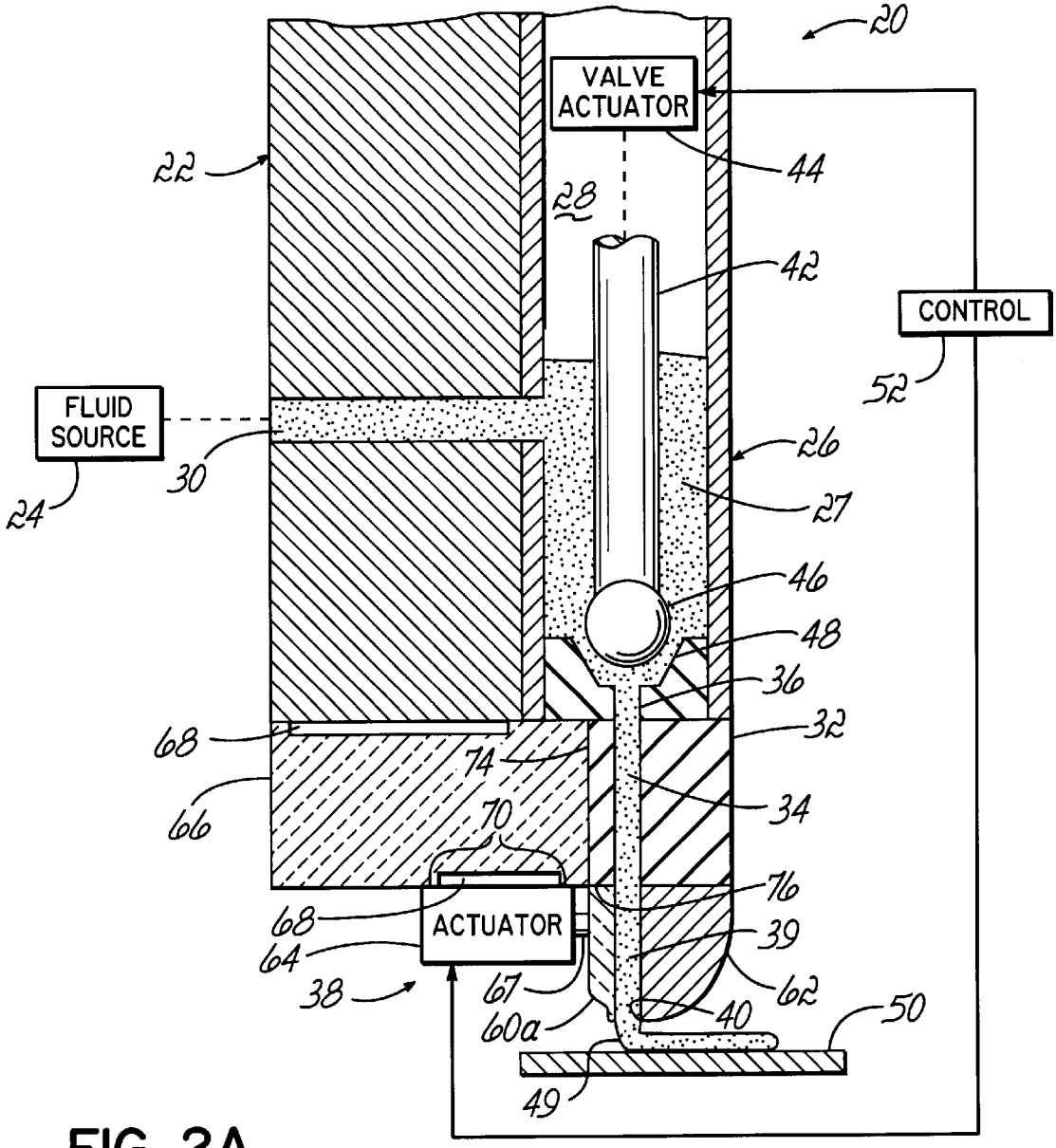
FIGS. 2A and 2B are schematic, partial cross-sectional diagrams illustration an operation of a fluid dispensing system employing another embodiment of the snuff-back die in accordance with the principles of the present invention.

FIG. 2A illustrates another structure for the snuff-back die 38 in which a movable die lip 60*a* is connected to the movable portion 67 of the actuator 64. The movable die 60*a* is mounted to translate with respect to a lower side 76 of the manifold 32 in response to the operation of the actuator 64. In a first embodiment, the movable die lip 60*a* may be assembled with the fixed die lip 62 to form a slot die assembly 38 that permits relative motion of the movable die lip 60*a* with respect to the fixed die lip 62. For example, the fasteners used to assemble the die lips 60*a*, 62 together can be less than fully tightened. Such a construction may require a compressible fluid seal between die lips 60*a*, 62 that does not inhibit motion of the movable lip. In this embodiment, the slot die assembly 38 provides some support of the movable die lip 60*a*. In a second embodiment, the movable die lip 60*a* may be assembled to the manifold 32 or another part of the dispensing head 22 independent of the fixed die lip 62 and in a manner permitting the movable lip 60 to translate. In a third embodiment, the movable die lip 60*a* is rigidly connected to and fully supported by the movable element 67 of the actuator 64.

Figure 2B:
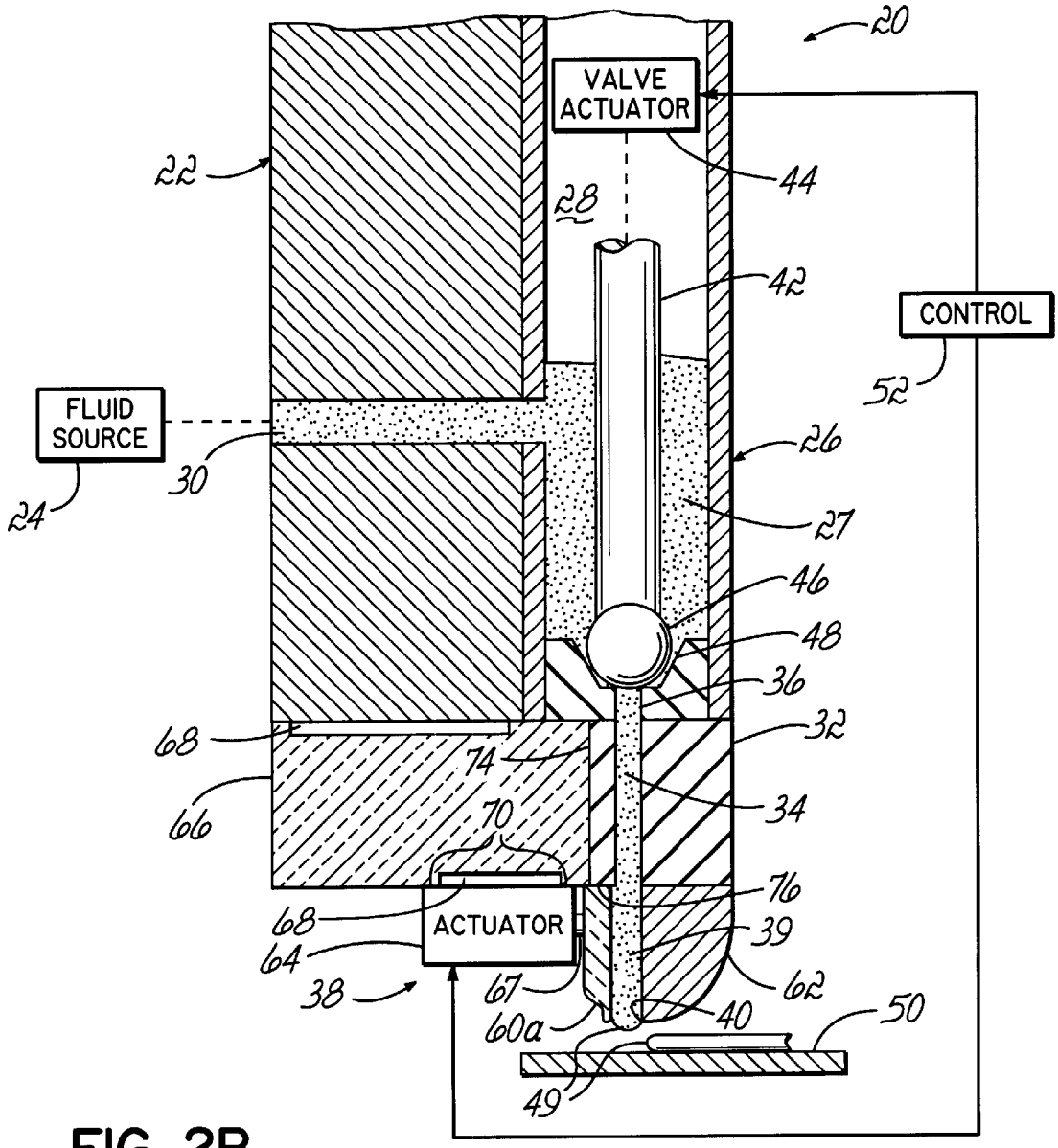

Although not shown in FIG. 2A, fluid from the fluid dispensing valve 26 is often ported through one of the die lips 60*a*, 62. If fluid were ported through the movable lip 60*a*, a seal would be required between the movable die lip 60*a* and the manifold 32. However, such a seal would not be required if the fluid is ported through the fixed lip 62. In any of the above embodiments, the movable die 60*a* may also be supported and guided by structure between it and the bottom side 76 of the manifold plate 32, for example, a dovetail configuration. Further, in any of the above embodiments with respect to FIG. 2A, the actuator 64 is used to move the movable lip 60*a* away from the fixed die 62 as shown in FIG. 2B. By translating the movable lip 60*a* away from the fixed lip 62, the size of the die cavity 39 is increased to receive and contain excess fluid resulting from the dispensing valve 26 closing. Thereafter, the actuator 64 translates the movable lip 60*a* back to the position shown in FIG. 2A to dispense the contained excess fluid.

In use, when it is desired to dispense fluid onto the substrate 50, a control 52, electrically connected to the valve actuator 44, causes the supply valve 26 to open. In that process, the control 52 switches the state of the valve actuator 44 in a known manner to cause the valve ball 46 to be lifted from the valve seat 48, thereby initiating a flow of fluid 49 through the slot die opening 40 and onto the substrate 50. At the end of the fluid dispensing process, the control 52 causes the supply valve to close by again switching the state of the valve actuator 44, thereby allowing the valve stem 42 and the valve ball 46 to return to the valve seat 48. Often that return motion is caused by a valve return spring (not shown). The control 52 also provides a command signal to the actuator 64 in association with a portion of the fluid dispensing cycle at which the supply valve 26 is commanded to close. For example, the actuator 64 may be actuated before, simultaneously with or after the control 52 commands the fluid dispensing valve 26 to close. The command signal causes the actuator 64 to move or deflect the movable die lip 60 away from the fixed die lip 62, thereby increasing the thickness and expanding the volume of the slot die opening 40. Thus, any extra fluid injected into the fluid path 34 and die opening 40 by the downward motion of the valve ball 46 is contained in the expanded volume of the die opening 40 instead of being deposited onto the substrate 50. The containment of that extra fluid in the increased volume of the slot die opening 40 provides a snuff-back capability and a sharp delineation or cut-off of fluid flow from the die 38.

When the next fluid dispensing cycle is initiated, the valve actuator 44 lifts the valve ball 46 off of the valve seat 48, thereby permitting the fluid flow through the slot die opening 40 and onto the substrate 50. The actuator 64 is again operated by the control 52 in association with an initiation of the fluid dispensing cycle. The actuator 64 is operative to move the movable lip 60 back to its original position with respect to the fixed lip 62, thereby reducing the thickness of the die slot 40 and returning the die opening 40 to its original volume. The exact timing of the respective operations of the actuators 44, 64 is application dependent and is normally determined by experience, for example, by running test fluid dispensing cycles.

It should be noted that actuator 64 could be a unidirectional device, that is, a device that is powered to a first position and returned its original position via a return spring or other device. Alternatively, the actuator 64 can be a bidirectional device having two powered states in which the actuator can be powered to a fully extended position or state and powered to a fully retracted position or state. With such an actuator, the control 52 provides command signals to the actuator 64 switching the actuator between those two states. In a further alternative, the actuator 64 may be a device subject to proportional control in one or both directions. Under proportional control, the control 52 provides command signals that are effective to move the actuator 64 to intermediate positions between the fully extended and fully retracted positions. With proportional control, the velocity of the actuator 64 is also controllable; and thus, the position of the movable lip 60 can be changed quickly or more slowly. In addition, a proportional control of the actuator 64 is able to control the position of the actuator 64 with a high degree of accuracy and repeatability. Thus, with proportional control of the actuator 64, the control 52 is capable of causing the movable die lip 60 to accurately and repeatably move to different deflections or positions at any time. Therefore, the volume of the die slot 40 can be subject to a real time, dynamic and adaptive control by quickly and precisely changing the position of the movable lip 60 throughout the fluid dispensing process. Such real time, dynamic control of the volume of the die slot 40 can improve the quality of the fluid dispensing process.

The capability of the snuff-back dies of FIGS. 1 and 2 to change their physical geometry and die slot volume in real time present unique opportunities to improve the quality and economy of a fluid dispensing process. Such a capability is especially useful in a die application in which the cut-off of fluid flow must be very precise and sharp. Further, to be able to realize a very sharp fluid flow cut-off in a slot die application that uses a dispensing valve having an upstream valve ball is also very beneficial. Such dispensing valves are simple, reliable and less expensive; however, such valves have an operation that is not conducive to a sharp fluid flow cut-off. Thus, many slot die applications use a plurality of fluid dispensing valves that are designed to provide a snuff-back capability. Such valves are more complex and expensive, and the opportunity to replace such valves with valves having an upstream valve ball represents a substantial opportunity for cost savings. Alternatively, the snuff-back die of FIGS. 1 and 2 can be used to replace pneumatic snuff-back devices that are also complex and expensive. Therefore, the ability to obtain a high quality fluid dispensing process using a dispensing valve with an upstream valve ball represents a substantial opportunity for cost savings both in the manufacture and the use of the fluid dispensing system. Further, the real time dynamic control over slot volume of a die presents other opportunities for adaptive control of the fluid dispensing process.

While the present invention has been illustrated by a description of various embodiments and while these embodiments have been described in considerable detail in order to describe a mode of practicing the invention, it is not the intention of Applicant to restrict or in any way limit the scope of the appended claims to such detail. Additional advantages and modifications within the spirit and scope of the invention will readily appear to those skilled in the art. For example, in the described embodiment, the illustrated die 38 of FIGS. 1 and 2 is a contact slot die. As will be appreciated, the movable die described herein may also be used with a noncontact slot die. Further, in other embodiments, the movable lip 60 described herein may be applied to dies other than slot dies. In FIG. 1, the movable lip 60 is deflected by the actuator 64; and in FIG. 2, the actuator 64 translates the movable lip 60. As will be appreciated, other embodiments may be utilized in which the movable lip 60 is moved by a combination of translation and deflection.

Therefore, the invention in its broadest aspects is not limited to the specific details shown and described. Consequently, departures may be made from the details described herein without departing from the spirit and scope of the claims that follow.

What is claimed is:

1. A method of changing a size of a die cavity of a die on a fluid dispensing apparatus having a dispensing valve, the die cavity having an upstream end in fluid communication with the dispensing valve and a downstream end with an opening for dispensing fluid onto a substrate, the the dispensing valve being operable to initiate and terminate a flow of fluid through the die cavity and onto a substrate, the method comprising:

providing a first die lip positioned adjacent a second die lip, the first die lip and the second die lip being separate from, and located downstream of, the dispensing valve and the first die tip and the second die lip defining the die cavity therebetween; and automatically moving the first die lip away from the second die lip with an actuator to increase the size of the opening and the die cavity and contain any fluid dispensed by the valve while terminating a flow of fluid through the die cavity.

2. The method of claim 1 further comprising automatically moving the first die lip toward the second die lip with an actuator to decrease the size of the die opening, so that the die opening is a desired size when fluid flows through the die cavity.

3. A method of providing a fluid snuff-back in a fluid dispensing system having a fluid dispensing valve operable to initiate and terminate a flow of fluid therethrough, the method comprising:

providing a die separate from, and located downstream of, the fluid dispensing valve, the die having a die cavity with an upstream end in fluid communication with the fluid dispensing valve and a downstream end with a die opening for dispensing the fluid from the die, the die having a first die lip positioned adjacent a second die lip to form a the die cavity therebetween;

closing the fluid dispensing valve to terminate a flow of fluid therethrough; and increasing a size of the die opening and the die cavity to contain in the die opening and the die cavity extra fluid dispensed by the fluid dispensing valve in the process of closing.

4. The method of claim 3 further comprising moving the first die lip away from the second die lip to increase the size of the die opening.

5. The method of claim 3 further comprising operating an actuator connected to the first die lip to move the first die lip away from the second die lip to increase the size of the die opening.

6. The method of claim 3 further comprising operating an electromechanical actuator connected to the first die lip to move the first die lip relative to the second die lip to increase the size of the die opening.

7. The method of claim 3 further comprising operating a fluid-operated actuator connected to the first die lip to move the first die lip relative to the second die lip to increase the size of the die opening.

8. The method of claim 3 comprising:

opening the fluid dispensing valve to initiate a flow of fluid therethrough; and decreasing the size of the die opening to dispense fluid contained in the die opening onto the substrate.

9. The method of claim 8 further comprising moving the first die lip relative to the second die lip to decrease the size of the die opening.

10. The method of claim 9 further comprising operating an actuator mechanically connected to the first die lip to move the first die lip toward the second die lip to decrease the size of the die opening.

11. A die receiving a fluid from a dispensing valve and dispensing the fluid onto a substrate, the die comprising:

a first lip adapted to be separate from, and located downstream of, the dispensing valve;

a rigid second lip disposed adjacent to the first lip and adapted to be separate from, and located downstream of, the dispensing valve, said rigid second lip being positioned adjacent said first lip to form a fluid cavity therebetween, said fluid cavity having an upstream end adapted to receive the fluid from the dispensing valve and a downstream end with an opening for dispensing the fluid onto the substrate; and an actuator connected to said first lip and operable to move said first lip relative to said second lip to change a size of said opening and said fluid cavity between said first lip and said second lip.

12. A fluid dispensing apparatus for dispensing fluid from a fluid source onto a substrate comprising:

a fluid dispensing valve adapted to be fluidly connected to the fluid source;

a die separate from, and located downstream of, said fluid dispensing valve, said die being fluidly connected to said fluid dispensing valve, said die comprising a first lip, a second lip positioned adjacent said first lip, said first lip and said second lip forming a fluid cavity therebetween, said fluid cavity having an upstream end adapted to receive the fluid from the fluid dispensing valve and a downstream end with an opening for dispensing the fluid and a lip actuator connected to said first lip and operable to move said first lip with respect to said second lip, thereby changing a size of said opening and said fluid cavity between said first lip and said second lip.

13. The fluid dispensing apparatus of claim 12 wherein said lip actuator is an electromechanical actuator.

14. The fluid dispensing apparatus of claim 12 wherein said lip actuator is a fluid operated actuator.

15. The fluid dispensing apparatus of claim 12 wherein said lip actuator is an electrohydraulic actuator.

16. The fluid dispensing apparatus of claim 12 wherein said first lip forms a first wall of a die slot through which a fluid is dispensable and said second lip forms an opposed, second wall of said die slot, and a distance between said first lip and said second lip determines a slot thickness and said tip actuator is operable to move said first lip relative to said second lip to change said thickness of said die slot.

17. The fluid dispensing apparatus of claim 16 wherein said first lip further comprises a contact area adapted to contact a surface of the substrate during a fluid dispensing process.

18. The fluid dispensing apparatus of claim 16 wherein said fluid dispensing valve further comprises a valve seat positioned downstream of an upstream valve ball, said valve ball movable in an upstream direction away from said valve seat to open said dispensing valve, and said valve ball movable in a downstream direction toward said valve seat to close said valve.

19. The fluid dispensing apparatus of claim 12 further comprising a manifold fluidly connected between the die and the fluid dispensing valve.

20. The fluid dispensing apparatus of claim 12 further comprising an insulating block supporting the actuator.

21. A fluid dispensing apparatus for dispensing fluid from a fluid source onto a substrate comprising:

a dispensing valve adapted to be fluidly connected to the fluid source and comprising a valve seat positioned downstream of an upstream valve ball, said valve ball movable in an upstream direction away from said valve seat to open said dispensing valve, and said valve ball movable in a downstream direction toward said valve seat to close said dispensing valve; and a die fluidly connected to said fluid dispensing valve, said die comprising a first lip adapted to be separate from, and located downstream of, the dispensing valve, said first lip forming a first wall of a die slot through which a fluid is dispensable, a second lip disposed adjacent to the first lip and adapted to be separate from, and located downstream of, the dispensing valve, said second lip forming an opposed, second wall of said die slot, and a distance between said first lip and said second lip determines a slot thickness, and a lip actuator connected to said first lip and operable to move said first lip with respect to said second lip to change the slot thickness of said die slot.

* * * * *

UNITED STATES PATENT AND TRADEMARK OFFICE

CERTIFICATE OF CORRECTION

PATENT NO. : 6,688,580 B2
DATED : February 10, 2004
INVENTOR(S) : John Jackson et al.

It is certified that error appears in the above-identified patent and that said Letters Patent is hereby corrected as shown below:

Column 8,
Line 18, change “tip” to -- lip --.
Line 40, delete “a”.

Column 10,
Line 6, change “tip” to -- lip --.

Signed and Sealed this

Twenty-second Day of March, 2005

JON W. DUDAS
*Director of the United States Patent and Trademark Office*